United States Patent [19]

Loyd

[11] Patent Number: 4,951,365

[45] Date of Patent: Aug. 28, 1990

[54] OVERCENTER BUCKLE

[75] Inventor: Bruce L. Loyd, Lawrence, Kans.

[73] Assignee: Kinedyne Corporation, North Branch, N.J.

[21] Appl. No.: 382,415

[22] Filed: Jul. 20, 1989

[51] Int. Cl.[5] ..... A44B 21/00

[52] U.S. Cl. ..... 24/68 CD; 24/196

[58] Field of Search ..... 24/68 CD, 68 E, 71.2, 24/196, 493

[56] References Cited

U.S. PATENT DOCUMENTS

| | | | |
|---|---|---|---|
| 2,874,431 | 2/1959 | Elsner | 24/71.2 |
| 3,866,272 | 2/1975 | Prete, Jr. et al. | 24/68 CD |
| 3,887,966 | 6/1975 | Gley | 24/68 CD |
| 4,227,286 | 10/1980 | Holmberg | 24/68 CD |
| 4,464,811 | 8/1984 | Holmes | 24/68 CD |

OTHER PUBLICATIONS

Tow pages from Ancra International Catalog Disclosing Overcenter Buckles (pp. 34 and 35).

*Primary Examiner*—Victor N. Sakran

*Attorney, Agent, or Firm*—Beaman & Beaman

[57] ABSTRACT

The invention pertains to an improved overcenter buckle for tensioning straps used for securing cargo during transport wherein the buckle includes a handle pivotally mounted upon a U-shaped body, and the tension strap is threaded through the handle wherein pivoting thereof between open and closed positions tensions the strap. The improved construction comprises a lock plate slidably mounted on the body displaceable between handle lock and release positions and the lock plate is sufficient spaced from the handle to allow handle clearance during release.

5 Claims, 1 Drawing Sheet

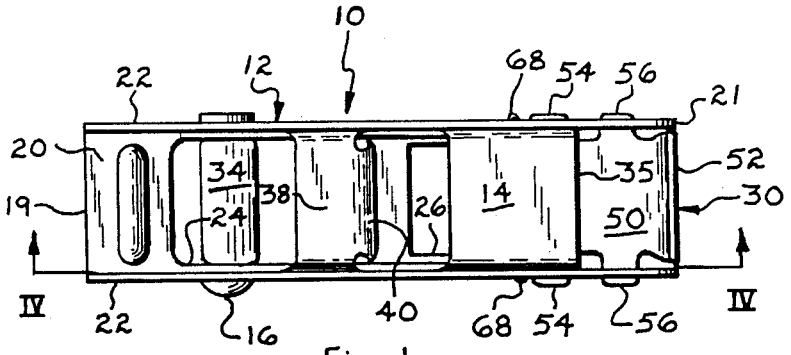
Fig 1
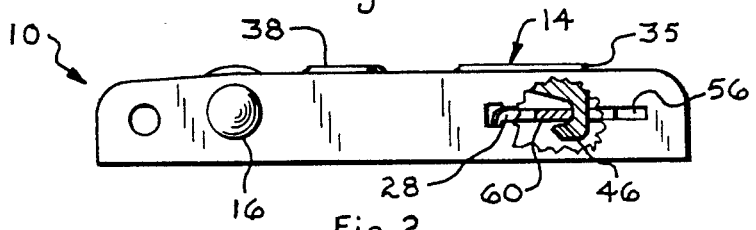
Fig 2
Fig 5
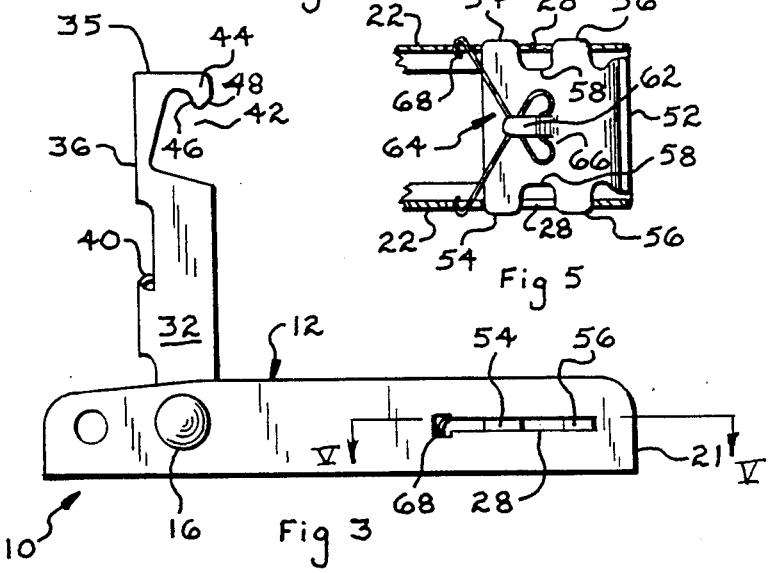
Fig 3
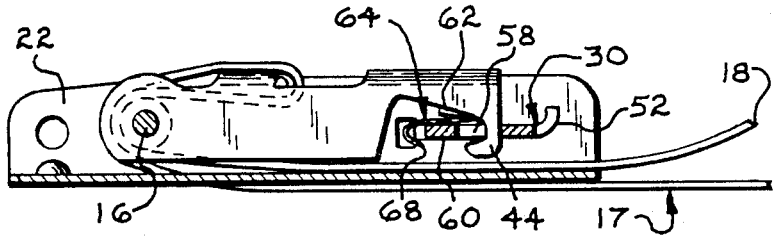
Fig 4

OVERCENTER BUCKLE

BACKGROUND OF THE INVENTION

Overcenter buckles are commonly employed with tensioning straps used in cargo hold-down systems to produce a relatively high tension in the straps to prevent the cargo from shifting during transport. Such overcenter buckles usually consist of a handle pivotally mounted upon a body, and the strap is looped through the handle wherein pivoting thereof between open and closed positions tensions the strap. A latch assembly is usually mounted upon the handle having movement therewith and cooperates with catch portions defined upon the body when the handle is pivoted to the strap tensioning position for maintaining the handle in the closed position. Typical examples of such types of overcenter buckles are shown in U.S. Pat. No. 3,866,272 and the assignee's U.S. Pat. No. 4,464,811.

As apparent from the above patents, the buckle assembly is readily operable, easy to assemble and relatively inexpensive to manufacture. However, the fact that the latch assembly is located on the handle and has movement therewith requires the operator's fingers to be placed in close proximity of the pivot path of the handle when releasing the buckle which is undesirable as often the buckles are under high tension and releasing the handle from the closed tension position causes the handle to rapidly open possibly resulting in serious injury to the operator.

It is a object of the invention to provide an overcenter buckle having a body and a handle pivotally mounted thereon displaceable between closed and open positions wherein the buckle is readily operable, economical to manufacture and includes a latch assembly mounted on the body having a portion remotely located from the pivot path of the handle to facilitate release of the handle from the closed position under high tension conditions without the likelihood of causing serious injury to the operator.

It is a further object of the invention to provide an overcenter buckle incorporating an improved latch assembly wherein the latch assembly includes a lock plate slidably mounted on the body that is of an economical stamped construction and may be easily assembled to the body, yet is dependable under high tension conditions even after long periods of extensive usage.

In the practice of the invention a buckle includes a U-shaped body having parallel outstanding leg portions interconnected by a base. A pivot pin extends between the body sides near one end of the body whereon a handle, also having a U-shaped configuration, is pivotally mounted at one end thereon positionable between a closed tension producing position and an open tension release position. The handle includes strap receiving openings through which the tension strap is threaded and upon the handle being pivoted to the strap tension position the strap is pulled about the pivot pin tending to shorten the strap and produce a tension therein. The free end of the handle, opposite to that of the pivotally mounted end, terminates in the central portion of the body when the handle is in the strap tension position.

The body sides include a slot wherein an elongated lock plate is slidably received displaceable between a lock position and a release position, and the plate is normally biased to the lock position by a spring. The lock plate consist of a generally flat portion having an upturned outer end, and the flat portion includes a pair of parallel edges each provided with a recess defining a pair of parallel spaced legs. The legs are received in the body slots in the central portion of the body and the outer end is located at one end of the body remotely spaced from the pivot path of the handle.

The handle sides are provided with locking notches defining an abutment edge which cooperates with the lock plate upon pivoting of the handle to its closed tensioning position whereby the abutment edges pass through the recesses and form an abutting relation with the underside of the legs to releasably lock the handle in the closed position. Opening of the handle is readily accomplished by displacing the lock plate to the release position by either engaging and displacing the plate outer end with the finger or by lifting upwardly on the strap which abuts against the curved end whereby the recesses align with the locking notches abutment edges permitting the handle to be pivoted to its open position.

The lock plate is of economical construction formed by stamped and bending processes, yet, is durable under high tension loading conditions. Also, the fact that the lock plate is located on the body and positioned so that the upturned outer end upon which the actuating force is applied is remotely spaced from the path of the pivoting handle permits the buckle to be safely released under high tension conditions reducing the likelihood of causing serious injury to the operator.

BRIEF DESCRIPTION OF THE DRAWINGS

The aforementioned objects and advantages of the invention will be appreciated from the following description and accompanying drawings wherein:

FIG. 1 is a top plan view of a buckle in accord with the invention illustrating the handle in the closed position, FIG. 2 is a elevational side view, partially in section, of the buckle of FIG. 1 as taken from the bottom of FIG. 1, FIG. 3 is a view similar to that of FIG. 2, illustrating the handle in the open position, FIG. 4 is an elevational, sectional view, taken along Section IV—IV of FIG. 1 after the lock plate has been moved to the release position, the strap being added for purpose of illustration, and FIG. 5 is a plan, detail, sectional view, taken along Section V—V of FIG. 3.

DESCRIPTION OF THE PREFERRED EMBODIMENT

In FIGS. 1–5 an overcenter buckle constructed in accord with the inventive concepts of the invention is shown generally indicated at 10. The buckle 10 includes a body 12 and a handle 14 pivotally mounted upon the body by a pivot pin 16. The web or strap 17 to be tensioned has a free end 18 and is looped about a rib defined on the handle radially spaced from the pivot wherein pivoting of the handle from an open or tensioned release position to a closed or tensioning position pulls the strap about the pivot tending to shorten the strap and produce a tension therein.

The body 12 is stamped of sheet metal and includes ends 19 and 21 and a base 20 from which depend parallel spaced legs or sides 22. The body base is formed with openings 24 and 26, and the sides 22 are provided with aligned slots 28 wherein a lock plate 30 is slidably received. The pivot pin 16 extends between the body sides 22 near end 19.

The handle 14 is also of a U-shaped configuration and formed of stamped metal, and is of a width capable of being received between the body sides 22. The handle sides 32 include holes at one end for receiving the pivot pin 16, and a tubular spacer sleeve 34 surrounds the pivot pin intermediate the handle sides. The other end 35 of the handle terminates in the central portion of the body 12 when the handle is in the closed position of FIGS. 1, 2 and 4. The handle base 36 is lanced inwardly defining an anchor rib 38 formed with a convex portion 40. The sides 32 are also provided with locking notches 42 defining a hook portion 44 including an abutment edge 46 adjacent an oblique camming surface 48.

The lock plate 30 is also formed of stamped metal and includes a generally flat portion 50 and a curved upturned outer end portion 52. The flat portion 50 includes a pair of front legs 54 and a pair of back legs 56 parallel spaced from the front legs 54 defining recesses 58. The legs 54 and 56 are slidably received within the slots 28 such that the front legs 54 are received in the central part of the body 12 and the curved end 52 is supported adjacent the end 21. The plate 30 is slidable between a lock position, FIGS. 1, 2, 3 and 5, and a release position, FIG. 4. The recesses 58 are of a substantial width such that the hook portion 44 may pass freely therethrough and the legs 54 have an underside 60 adapted to abut with the edge 46 when the handle is in its closed position and the plate 30 is in its locking position as illustrated in FIG. 2. A tab 62 is outwardly deflected from the flat portion 50 to serve as a support for a spring 64 which normally biases the plate 30 to the lock position toward the right, FIG. 5.

The spring 64 includes a loop 66 having a base portion received under the tab 62, and a pair of free ends 68 being rolled back to form a loop adapted to abut with the ends of the slots 28 as will be best appreciated in FIG. 5.

In operation, initially the handle is in the open position, FIG. 3, and the strap free end 18 is threaded through the body opening 26, passed under the sleeve 34, over and around the handle anchor rib 38, back over and under the sleeve 34 and is passed out through the body 12 under the plate 30 as illustrated in FIG. 4.

To tension the strap 17 the handle 14 is pivoted in a clockwise direction from the position of FIG. 3 to the closed position of FIGS. 1, 2 and 4. As the handle approaches the closed position the cam surfaces 48 engage the back edge of the legs 54 adjacent the recesses 58 which causes the plate 30 to start moving towards the left, FIG. 3. Movement of the plate 30 continues as the cam surfaces 48 engage the legs 54 until the hook portions 44 are in alignment with the recesses 58 and "drop" therethrough, FIG. 4. At this time, the resilience of the spring 64 causes the lock plate 30 to return to the lock position, FIG. 2, in which case the abutment edges 46 form an abutting relation with the leg undersides 60 to prevent counterclockwise rotation of the handle 14 with respect to the body 12. In this condition the buckle 10 is in its strap tensioning position.

The handle 14 may be released from the strap tension position by inwardly depressing the lock plate 30 to the release position of FIG. 4. This may be accomplished by either direct finger pressure to the curved end 52 or from lifting upwardly on the strap free end 18 abutting the strap 17 with the curved portion 52. In the release position, FIG. 4, the recesses 58 align with the hook portions 44 disengaging the abutment edges 46 from the leg underside 60 to permit the handle to be pivoted in the counterclockwise direction with respect to the body 12 in FIG. 4, and thereby releasing the tension in the strap 18.

The fact that the lock plate 30 is located on the body 12 and the curved portion 52 is remotely spaced from the handle end 35 permits the buckle to be safely released under high tension conditions minimizing the possibility of causing serious injury to the operator, whether the handle is released by finger or strap actuation. The plate 30 is economically fabricated by stamped and bending process and is easy to assemble, yet, even after extended periods of usage, is durable under high tension conditions.

It is to be appreciated that various modifications to the inventive concepts may be apparent to those skilled in the art without departing from the spirit and scope of the invention.

I claim:

1. An overcenter buckle for tensioning straps comprising a frame body having a U-shaped configuration defining spaced parallel sides having end edges and connected by a base, a handle pivotally mounted upon the frame body intermediate the frame body sides pivotal between tension and release positions, strap mounting means defined upon the handle, and latch means interposed between the frame body and handle to releasably lock the handle in its tension position, the improvement comprising, in combination, a latch guide slot defined in each frame body side, said latch means comprising an elongated lock plate slidably mounted on the frame body within said guide slots, a spring interposed between the frame body and said lock plate biasing said plate toward said lock position, said lock plate having an abutment surface, a latch surface defined on the handle engaging with said abutment surface when the handle is in the tension position maintaining the handle in the lock position, movement of said lock plate toward said lock plate release position against said spring disengaging said abutment and latch surfaces to permit the handle to be pivoted to the handle release position, said lock plate including a manually engaged operating portion remotely spaced from the handle.

2. In an overcenter buckle as in claim 1, said elongated lock plate including a generally flat portion having a pair of parallel edges and a curved end defining said manually engaged end operating portions, each of said edges being provided with a recess defining substantially parallel spaced front and back legs extending transversely to the associated edge in the same plane as said flat portion, said legs being received in said frame body guide slots defined in the frame body sides.

3. In an overcenter buckle as in claim 2, the handle including hook portions defined thereon, said latch surface being defined upon said hook portions.

4. In an overcenter buckle as in claim 3, a cam surface defined upon each of said hook portions, said cam portions engaging said lock plate as the handle is pivoted toward the tension position to displace said lock plate from its lock position to its release position.

5. An overcenter buckle for tensioning straps comprising a frame body having a U-shaped configuration defining spaced parallel sides having end edges and connected by a base, a handle pivotally mounted upon the frame body intermediate the frame body sides pivotal between tension and release positions, strap mounting means defined upon the handle, and latch means interposed between the frame body and handle to releasably lock the handle in its tension position, the improvement comprising, in combination, the latch means constituting a latch mounted on the frame body selectively movable between lock and release positions and having a manually operated handle portion and latch engageable means defined on the handle engaged by said latch when said latch is in said lock position to maintain the handle in its tension position, the handle having a free end having an arcuate path of movement as the handle pivots between its tension and release positions, said latch handle portion being remotely spaced from said handle free end path of movement.

* * * * *